US009651265B2

(12) United States Patent
Yantis et al.

(10) Patent No.: US 9,651,265 B2
(45) Date of Patent: May 16, 2017

(54) OVEN APPLIANCE WITH DUAL OPENING AND CLOSING DOORS

(75) Inventors: John Adam Yantis, Prospect, KY (US); John Mark Chilton, Campbellsburg, KY (US); Scott Thomas Kershner, LaGrange, KY (US); Eric Sugalski, Malvern, PA (US); David Schoon, Somerville, MA (US); David Perry, Cambridge, MA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 827 days.

(21) Appl. No.: 13/614,274

(22) Filed: Sep. 13, 2012

(65) Prior Publication Data

US 2014/0069408 A1 Mar. 13, 2014

(51) Int. Cl.

| | |
|---|---|
| ***F23M 7/00*** | (2006.01) |
| ***F24C 15/04*** | (2006.01) |
| ***F24C 15/02*** | (2006.01) |

(52) U.S. Cl.

CPC ..... *F24C 15/023* (2013.01)

(58) Field of Classification Search

CPC ..... A47B 96/16; F24C 15/023; F24C 15/162; E05F 17/004; E05F 15/611; F16B 5/208; F16B 39/32

See application file for complete search history.

(56) References Cited

U.S. PATENT DOCUMENTS 2,651,166 A * 9/1953 Dorfman ..... G04C 23/347 200/34
2,909,801 A * 10/1959 Ellis ..... E05F 3/102 16/62
2,929,152 A * 3/1960 Berner ..... C01B 11/185 34/169
3,009,458 A * 11/1961 Pearce ..... A47B 96/16 126/190
3,263,339 A * 8/1966 Brown ..... B01J 8/16 219/388
3,295,578 A * 1/1967 Maloof ..... F16B 5/0208 411/105
3,484,948 A * 12/1969 Whelan ..... B01J 8/36 165/104.16
3,680,222 A * 8/1972 Edmonds ..... B01F 13/0283 34/589
5,039,301 A * 8/1991 Allen ..... B01J 8/386 110/245
5,305,533 A * 4/1994 Alexander ..... F26B 11/028 34/108
5,406,914 A * 4/1995 Hyppanen ..... B01J 8/1836 110/245
5,782,010 A * 7/1998 Boersen ..... B01D 1/18 34/359

(Continued)

*Primary Examiner* — Kenneth Rinehart
*Assistant Examiner* — Wesley Anderson, Jr.
(74) *Attorney, Agent, or Firm* — Dority & Manning, P.A.

(57) ABSTRACT

The present subject matter provides an oven appliance. The oven appliance includes a cabinet that defines a chamber. A pair of doors is rotatably mounted to provide selective access to the chamber of the cabinet. A linkage assembly connects the doors of the pair of doors such that the doors rotate open and closed simultaneously. The linkage assembly includes a pair of gears that transfer rotational motion of one door to another door of the pair of doors.

16 Claims, 8 Drawing Sheets

(56) References Cited

U.S. PATENT DOCUMENTS

| | | | | |
|---|---|---|---|---|
| 7,814,897 | B2 | 10/2010 | Larsen | |
| 2007/0193926 | A1* | 8/2007 | Ness | B03B 4/06 209/133 |
| 2007/0246036 | A1 | 10/2007 | Larsen et al. | |
| 2009/0045311 | A1* | 2/2009 | Seyedin | F16C 19/10 248/349.1 |
| 2009/0145031 | A1 | 6/2009 | Collene | |
| 2010/0139169 | A1* | 6/2010 | Patil | E05F 17/004 49/103 |

* cited by examiner

OVEN APPLIANCE WITH DUAL OPENING AND CLOSING DOORS

FIELD OF THE INVENTION

The present subject matter relates generally to oven appliances, e.g., French door oven appliances.

BACKGROUND OF THE INVENTION

Oven appliances generally include a cabinet that defines a chamber for receipt of food items for cooking. The oven appliance's cabinet also defines an opening that permits access to the chamber. A door or doors mounted at the opening of the cabinet can selectively limit access to the chamber of the cabinet. For example, an oven appliance can include a pair of doors rotatably mounted at the opening of the cabinet. Such oven appliances are generally referred to as French door oven appliances.

Certain French door oven appliances include a linkage assembly that connects the oven appliance's pair of doors such that the doors open and close simultaneously. Such a configuration can be useful. For example, the pair of doors can each include a handle. By providing a linkage assembly that connects the pair of doors, a user can pull on either handle in order to open or close both of the doors simultaneously. Thus, a user holding food items in one hand can open or close both doors with the other free hand.

Certain French door oven appliances include linkage assemblies that have a large number of cumbersome linkage bars. Such assemblies can occupy a considerable volume of valuable space above the oven appliance's chamber. Also, manufacturing, assembly, and operation of such linkage assemblies can be complex and expensive.

Certain other French door oven appliances include linkage assemblies that have a chain and sprocket. However, such assemblies have disadvantages. For example, such assemblies can require the chain to cross itself in order for the doors rotate in the same direction and such crossing can result in the chain rubbing on itself. Further, such assemblies can require time consuming tightening of the chain during the assembly process.

Accordingly, an oven appliance with features for simultaneously opening and closing doors of the oven appliance would be useful. In particular, an oven appliance with a linkage assembly for simultaneously opening and closing doors of the oven appliance that preserves valuable space above a chamber of the oven appliance would be useful.

BRIEF DESCRIPTION OF THE INVENTION

The present subject matter provides an oven appliance. The oven appliance includes a cabinet that defines a chamber. A pair of doors is rotatably mounted to provide selective access to the chamber of the cabinet. A linkage assembly connects the doors of the pair of doors such that the doors rotate open and closed simultaneously. The linkage assembly includes a pair of gears that transfer rotational motion of one door to another door of the pair of doors. Additional aspects and advantages of the invention will be set forth in part in the following description, or may be apparent from the description, or may be learned through practice of the invention.

In a first exemplary embodiment, an oven appliance. The oven appliance includes a cabinet that defines a chamber for the receipt of food items for cooking. The chamber being accessible through an opening defined by the cabinet. The oven appliance also includes a heating element for providing heat to the food items for cooking in the chamber of the cabinet. A first door is rotatably mounted proximate the opening of the cabinet. A second door is also rotatably mounted proximate the opening of the cabinet. The first door and the second door are rotatable between an open position and a closed position in order to permit selective access to the chamber of the cabinet through the opening of the cabinet. A linkage assembly couples the first door and the second door such that the first door and the second door rotate between the open position and the closed position simultaneously. The linkage assembly includes a first linkage arm, a second linkage arm, a first gear, and a second gear. The first linkage arm extends between a first end portion and a second end portion. The first end portion of the first linkage arm is connected to the first door. The second end portion of the first linkage arm is connected to the first gear. The second linkage arm extends between a first end portion and a second end portion. The first end portion of the second linkage arm is connected to the second door. The second end portion of the second linkage arm is connected to the second gear. The first gear has a plurality of teeth, and the second gear has a plurality of teeth. The plurality of teeth of the second gear engages the plurality of teeth of the first gear.

In a second exemplary embodiment, an oven appliance is provided. The oven appliance includes a cabinet that defines a chamber for receipt of food items for cooking. The chamber is accessible through an opening defined by the cabinet. The oven appliance includes a heating element for providing heat to the food items for cooking in the chamber of the cabinet. A pair of doors is rotatably mounted proximate the opening of the cabinet. The pair of doors is rotatable between an open position and a closed position in order to permit selective access to the chamber of the cabinet through the opening of the cabinet. A linkage assembly couples the pair of doors together such that the pair of doors rotates between the open position and the closed position simultaneously. The linkage assembly includes a pair of gears. Each gear of the pair of gears has an axis of rotation about which the gear is rotatable. Each gear of the pair of gears has a plurality of teeth. The plurality of teeth of one of the pair of gears engages the plurality of teeth of the other of the pair of gears. Each gear of the pair of gears has an engagement surface radially spaced apart from the axis of rotation of the gear. The plurality of teeth is disposed on the engagement surface. The linkage assembly also includes a pair of linkage arms. Each linkage arm of the pair of linkage arms extends between and connects one of the pair of doors and one of the pair of gears.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 4, the pair of doors is shown in a closed position. In FIG. 6, the pair of doors is shown in a fully open position. In FIG. 5, the pair of doors is shown in a partially opened position between the closed position shown in FIG. 4 and the fully open position shown in FIG. 6.

DETAILED DESCRIPTION

Figure 1:
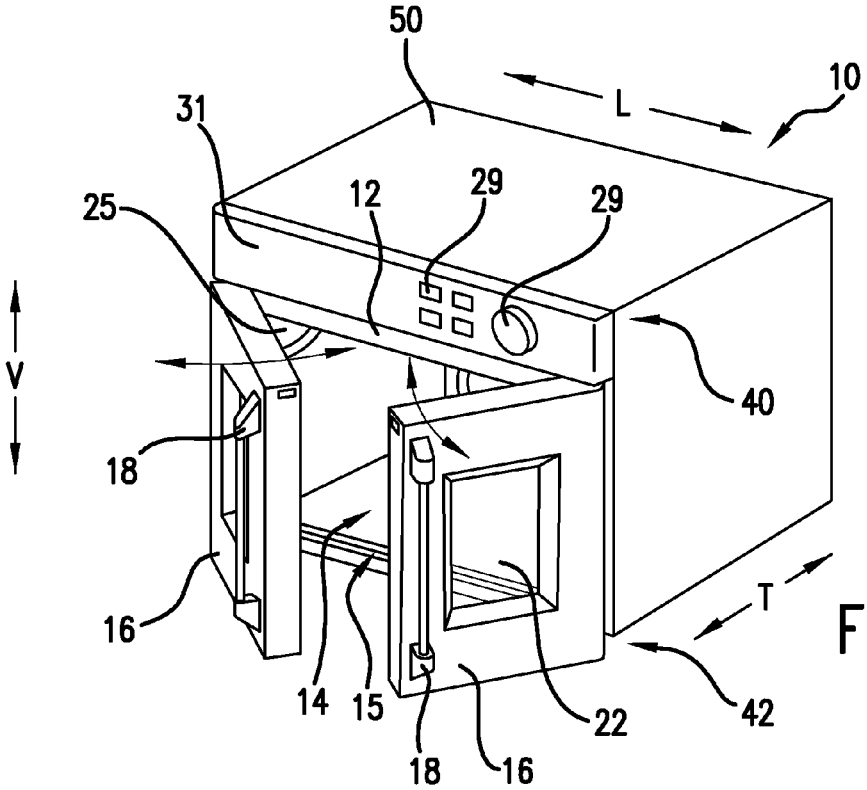
FIG. 1 provides a front perspective view of an oven appliance according to an exemplary embodiment of the present subject matter and, in particular, illustrates a pair of doors of the oven appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
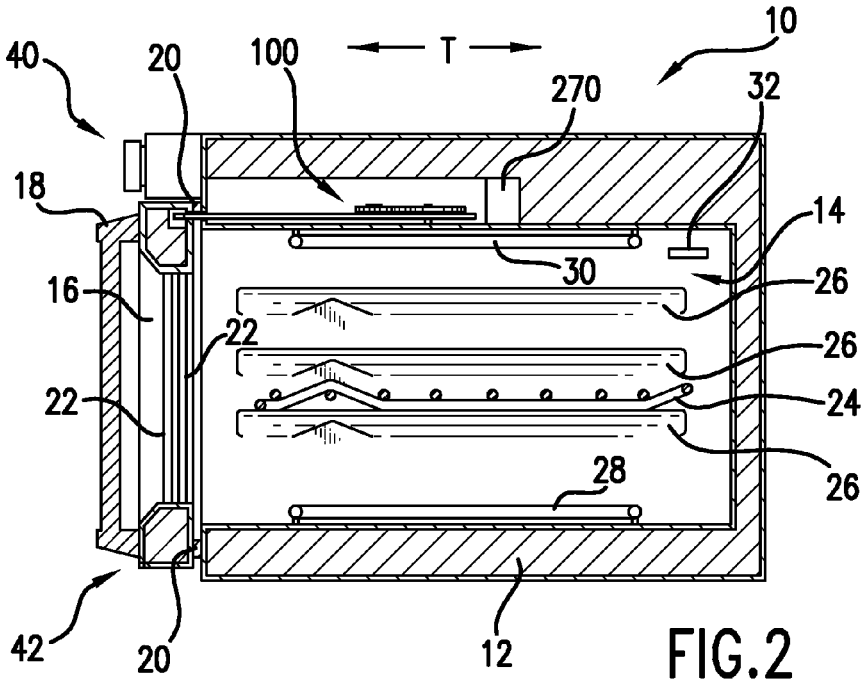
FIG. 2 provides a side cross-sectional view of the oven appliance of FIG. 1 and, in particular, illustrates a linkage assembly according to an exemplary embodiment of the present subject matter. The linkage assembly connects the pair of doors such that each door of the pair of doors rotates open and closed simultaneously.

FIGS. 1 and 2 illustrate an oven appliance 10 according to an exemplary embodiment of the present subject matter. Oven appliance 10 includes an insulated cabinet 12 with an interior surface 25 that defines an interior cooking chamber 14. Cooking chamber 14 is configured for the receipt of one or more food items to be cooked.

Cabinet 12 defines a vertical direction V, a lateral direction L, and a transverse direction T. The vertical direction V, the lateral direction L, and the transverse direction T are mutually perpendicular and form an orthogonal direction system. Cabinet 12 extends between a top 40 and a bottom 42 along the vertical direction V.

Oven appliance 10 includes a pair of doors 16, sometimes referred to as "French doors," rotatably mounted to cabinet 12 proximate an opening 15 to cooking chamber 14. Thus, oven appliance 10 is sometimes referred to as a French door style oven appliance. Pair of doors 16 is configured for selectively shifting between an open configuration shown in FIG. 1 in which a user can access cooking chamber 14 and a closed configuration shown in FIG. 2 in which the user is impeded from accessing cooking chamber 14 by pair of doors 16. Handles 18 are attached to each door of pair of doors 16 and allow for opening and/or closing one or both of the pair of doors 16.

One or more seals 20 between pair of doors 16 and cabinet 12 provide for maintaining heat and cooking fumes within cooking chamber 14 when pair of doors 16 is closed as shown in FIG. 2. Glass panes 22 provide for viewing the contents of cooking chamber 14 when door 16 is closed as well as providing insulation between cooking chamber 14 and the exterior of oven appliance 10. A rack 24 is positioned in cooking chamber 14 for supporting food items thereon. Rack 24 is slidably received onto ribs or rails 26 such that rack 24 may be conveniently moved into and out of cooking chamber 14 when door 16 is open. Multiple rails 26 are provided so that the height of rack 24 may be adjusted.

Heating elements or sources 28 and 30 are positioned within cooking chamber 14 of cabinet 12. Heating elements 28 and 30 are used to heat cooking chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown), e.g., a microprocessor. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside cooking chamber 14.

Oven appliance 10 is provided by way of example only. Thus, the present subject matter may be used with other oven configurations, e.g., an oven range. As another example, the present subject matter may be used with an oven defining multiple interior cavities for the receipt of food and/or having different pan or rack arrangements than what is shown in FIG. 2. Heating elements at the top, back, or sides of cooking chamber 14 may also be provided. The present subject matter may also be used with ovens having a variety of different types of heating elements such as microwave, halogen, gas fuel, electrical resistance, and combinations thereof. Pair of doors 16 may also be mounted to cabinet 12 in any other suitable manner or configuration. Other configurations may also be used as will be understood by one of skill in the art using the teachings disclosed herein.

As may be seen in FIG. 2, a linkage assembly 100 is positioned at top 40 of cabinet 12. Linkage assembly 100 connects pair of doors 16 such that pair of doors 16 rotate open and closed simultaneously. Thus, for example, a user may pull on one of handles 18 in order to open both doors of the pair of doors 16. Linkage assembly 100 is discussed in greater detail below.

Figure 3:
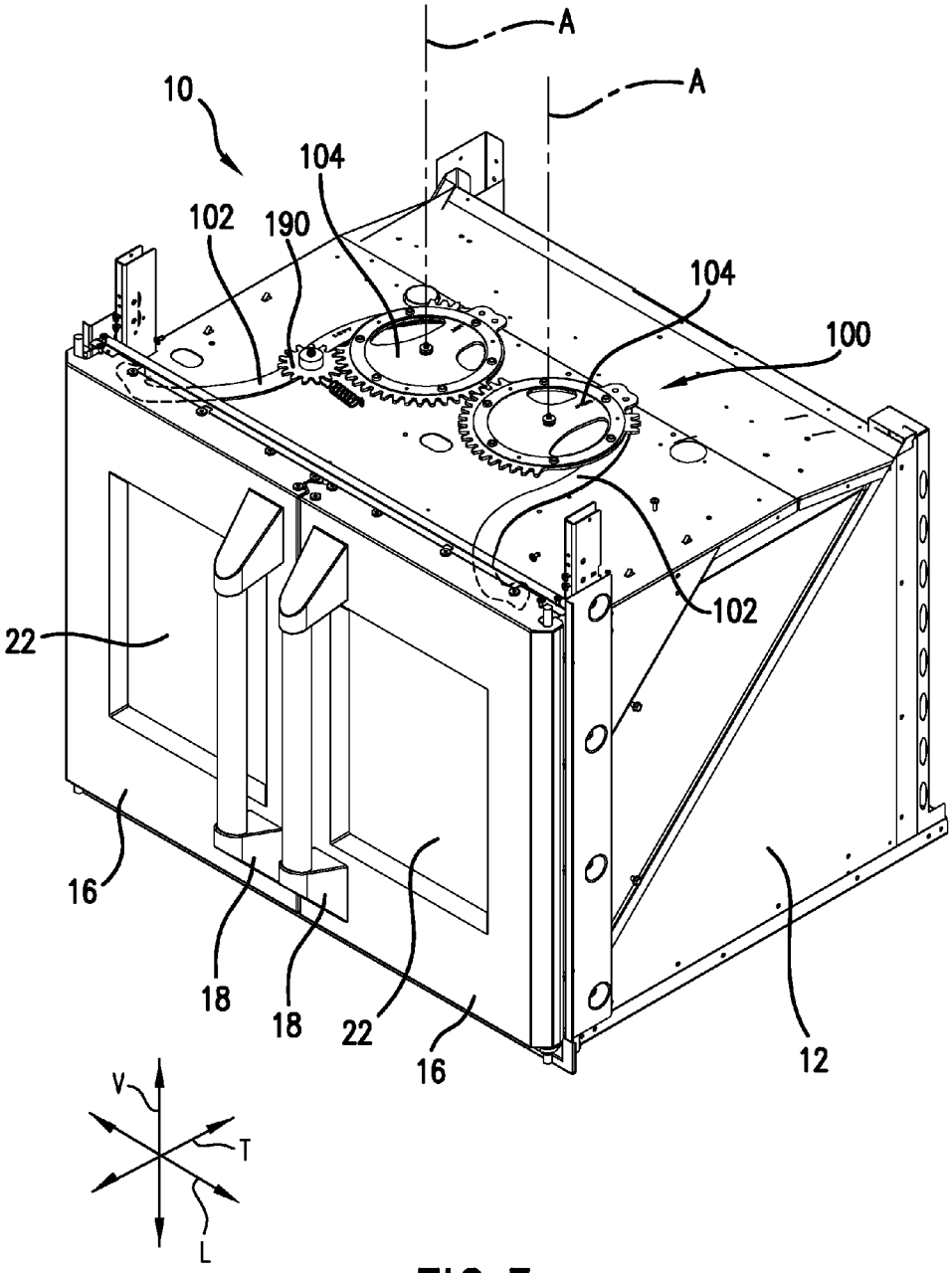
FIG. 3 provides a perspective view of the oven appliance of FIG. 1 with a hood of the cabinet removed to show the linkage assembly of the oven appliance.
Figure 4:
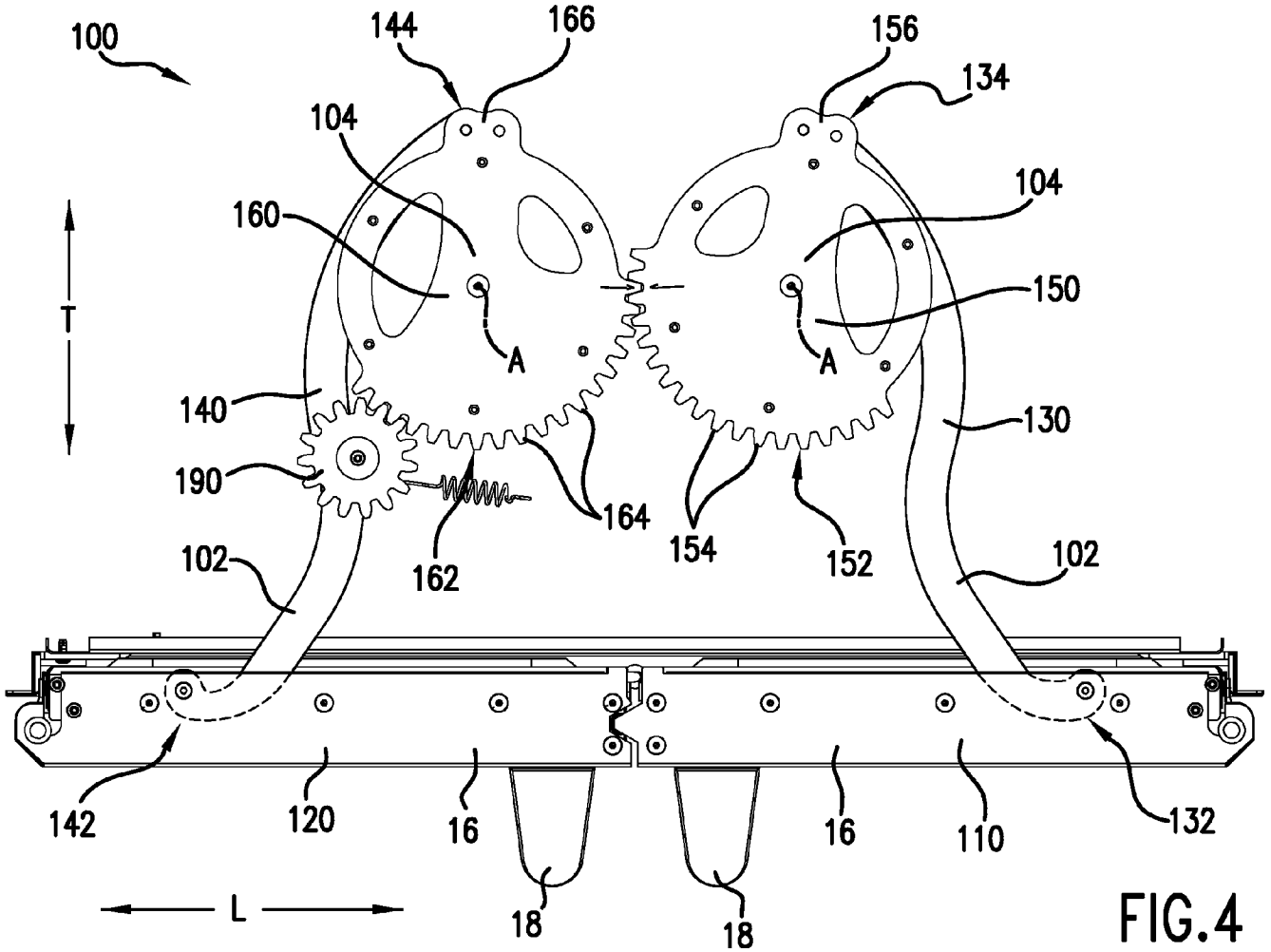
FIGS. 4-6 illustrate plan views of the pair of doors and the linkage assembly removed from the oven appliance of FIG. 1 for clarity.
Figure 5:
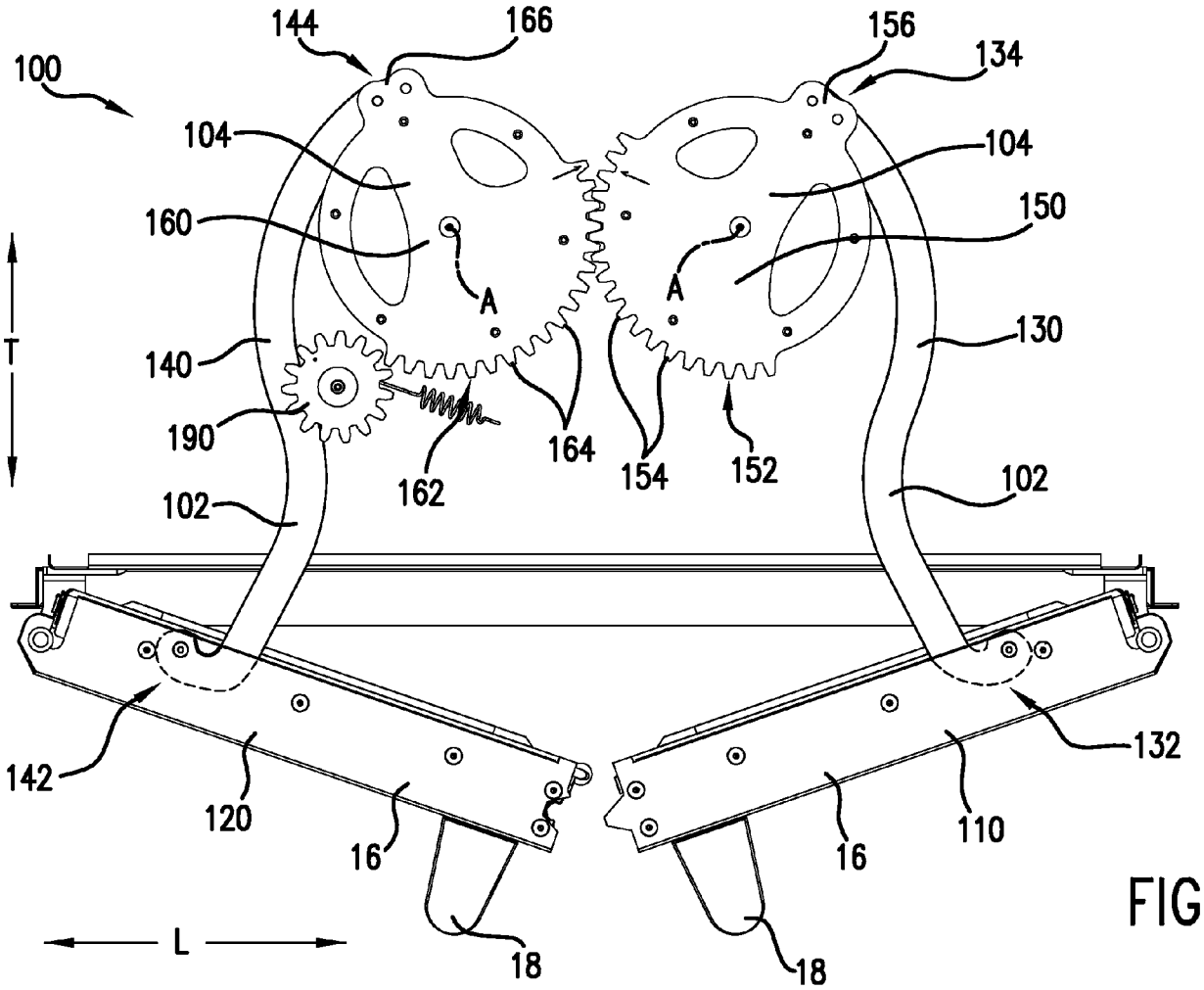
Figure 6:
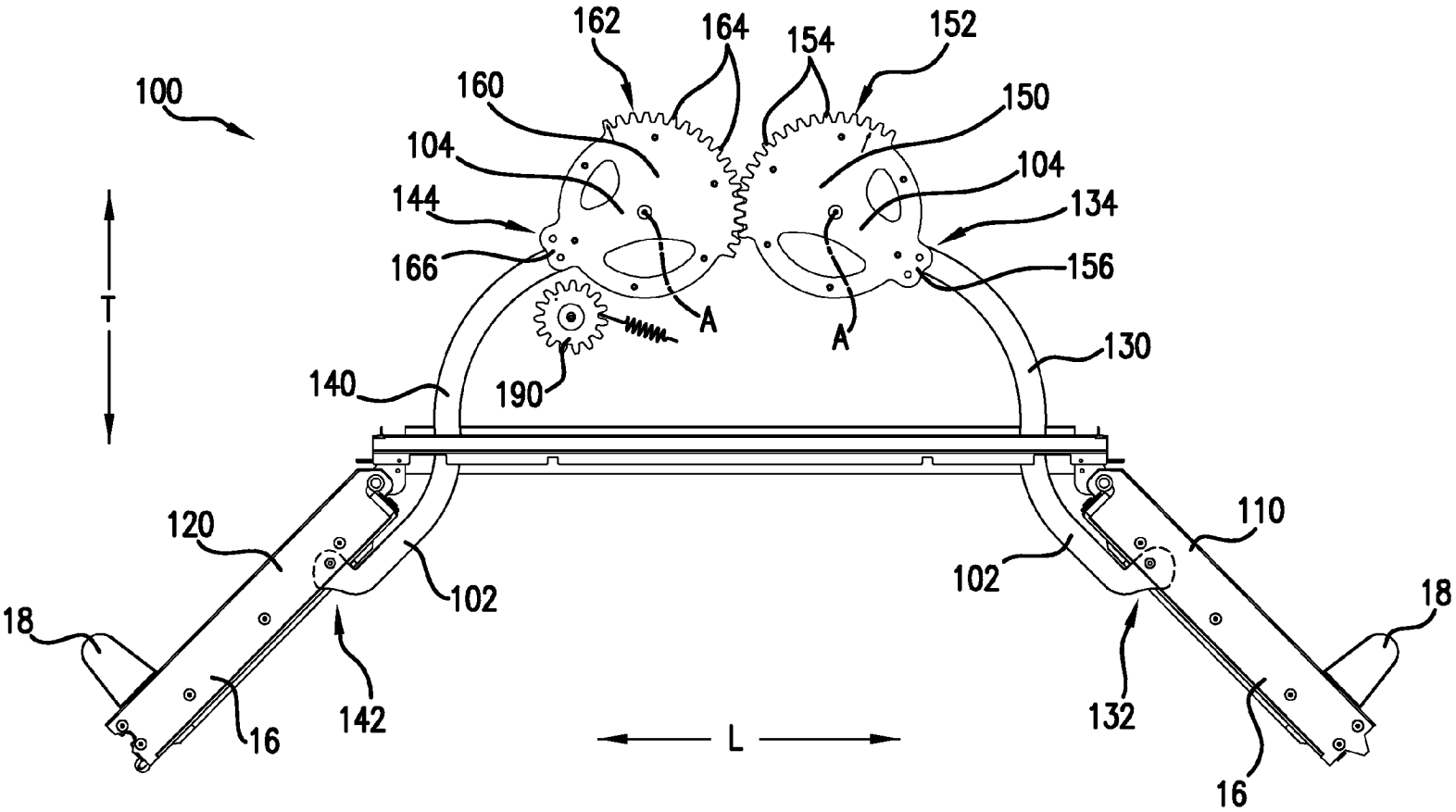

FIG. 3 provides a perspective view of oven appliance 10 with a hood 50 (FIG. 1) of cabinet 12 removed to show linkage assembly 100. FIGS. 4-6 illustrate pair of doors 16 and linkage assembly 100 removed from oven appliance 10 (FIG. 1) for clarity. In FIG. 4, pair of doors 16 is shown in the closed position. Conversely, in MG. 6, pair of doors 16 is shown in the fully open position. In FIG. 5, pair of doors 16 is shown partially opened, i.e., between the closed position shown in FIG. 4 and the fully open position shown in FIG. 6.

As may be seen in FIG. 3, linkage assembly 100 includes a pair of gears 104. Each gear of pair of gears 104 has an axis of rotation A (FIG. 3) about which the gear is rotatable. Pair of gears 104 engage one another, e.g., to transfer rotation motion between pair of doors 16. Linkage assembly 100 also includes a pair of linkage arms 102. Each linkage arm of pair of linkage arms 102 extends between and connects one of the pair of doors 16 and one of the pair of gears 104.

As may be seen in FIG. 4, pair of doors 16 includes a first door 110 and a second door 120. Also, pair of linkage arms 102 includes a first linkage arm 130 and a second linkage arm 140. In addition, pair of gears 104 includes a first gear 150 and a second gear 160. First and second gears 150 and 160 may be rotatably mounted to cabinet 12 as shown in FIG. 3. In alternative exemplary embodiments, first and second gears 150 and 160 may be rotatably mounted to other portions of oven appliance 10.

Linkage assembly 100 also includes a spur gear 190 that engages second gear 160. Spur gear 190 can, e.g., maintain first and second doors 110 and 120 in the closed position as will be understood by those skilled in the art. Other suitable mechanisms for maintaining first and second doors 110 and 120 in the open and/or closed position may be provided in alternative exemplary embodiments.

First linkage arm 130 extends between a first end portion 132 and a second end portion 134. Similarly, second linkage arm 140 extends between a first end portion 142 and a second end portion 144. First end portion 132 of first linkage arm 130 is rotatably connected or mounted to first door 110, and second end portion 134 of first linkage arm 130 is rotatably connected or mounted to first gear 150. First end portion 142 of second linkage arm 140 is rotatably connected or mounted to second door 120, and second end portion 144 of second linkage arm 140 is rotatably connected or mounted to second gear 160.

First gear 150 and second gear 160 each have an engagement edge 152 and 162, respectively. Engagement edge 152 of first gear 150 is positioned on first gear 150 such that engagement edge 152 is radially spaced apart from the axis of rotation A of first gear 150. Similarly, engagement edge 162 of second gear 160 is positioned on second gear 160 such that engagement edge 162 is radially spaced apart from the axis of rotation A of second gear 160.

First gear 150 and second gear 160 also both have a plurality of teeth 154 and 164, respectively. The plurality of teeth 154 of first gear 150 engages the plurality of teeth 164 of second gear 160 to transfer rotation motion between first door 110 and second door 120. The plurality of teeth 154 of first gear 150 is disposed on engagement edge 152 of first gear 150. Similarly, the plurality of teeth 164 of second gear 160 is disposed on engagement edge 162 of second gear 160. In particular, pluralities of teeth 154 and 164 are uniformly, e.g., circumferentially, distributed on engagement edges 152 and 162 of first and second gears 150 and 160, respectively.

First and second gears 150 and 160 each have a leg 156 and 166, respectively. Leg 156 of first gear 150 extends away from axis of rotation A of first gear 150, and leg 166 of second gear 160 extends away from the axis of rotation A of second gear 160. Second end portion 134 of first linkage arm 130 is rotatably mounted to leg 156 of first gear 150, and second end portion 144 of second linkage arm 140 is rotatably mounted to leg 166 of second gear 160.

As may be seen in FIG. 4, first and second gears 150 and 160 are substantially identical. Thus, each gear of pair of gears 104 is interchangeable with the other of the pair of gears 104. Similarly, first and second linkage arms 130 and 140 are substantially identical (e.g., in FIG. 4, first and second linkage arms 130 and 140 are ogee shaped). Thus, each linkage arm of pair of linkage arms 102 is interchangeable with the other of the pair of linkage arms 102. Such interchangeability between components of linkage assembly 100 can lower manufacturing costs and/or facilitate assembly of linkage assembly 100 and oven appliance 10.

Linkage assembly 100 connects first and second doors 110 and 120 such that first and second doors 110 and 120 rotate open and closed simultaneously. As an example, with first and second doors 110 and 120 in the closed position shown in FIG. 4, a user may pull on handle 18 of first door 110 (or handle 18 of second door 120) to urge first door 110 to begin rotating open. As first door 110 beings to rotate open, first linkage arm 130 can transfer such rotation motion to first gear 150. In turn, plurality of teeth 154 of first gear 150 engages plurality of teeth 164 of second gear 160 to transfer such rotation motion from first gear 150 to second gear 160. Second gear 160 then transfers such rotation motion to second door 120 via second linkage arm 140. Thus, linkage assembly 100 can transfer rotation motion generated by the user between the first door 110 and the second door 120 to shift first and second doors 110 and 120 to the partially opened position shown in FIG. 5. If the user continues to pull handle 18 of first door 110, the first and second doors 110 and 120 will continue to rotate simultaneously to the fully opened position shown in FIG. 6.

As will be understood by those skilled in the art, linkage assembly 100 is provided by way of example only. Other suitable alternative mechanisms may be used to connect pair of doors 16 such that pair of doors 16 rotate open and closed simultaneously.

Figure 7:
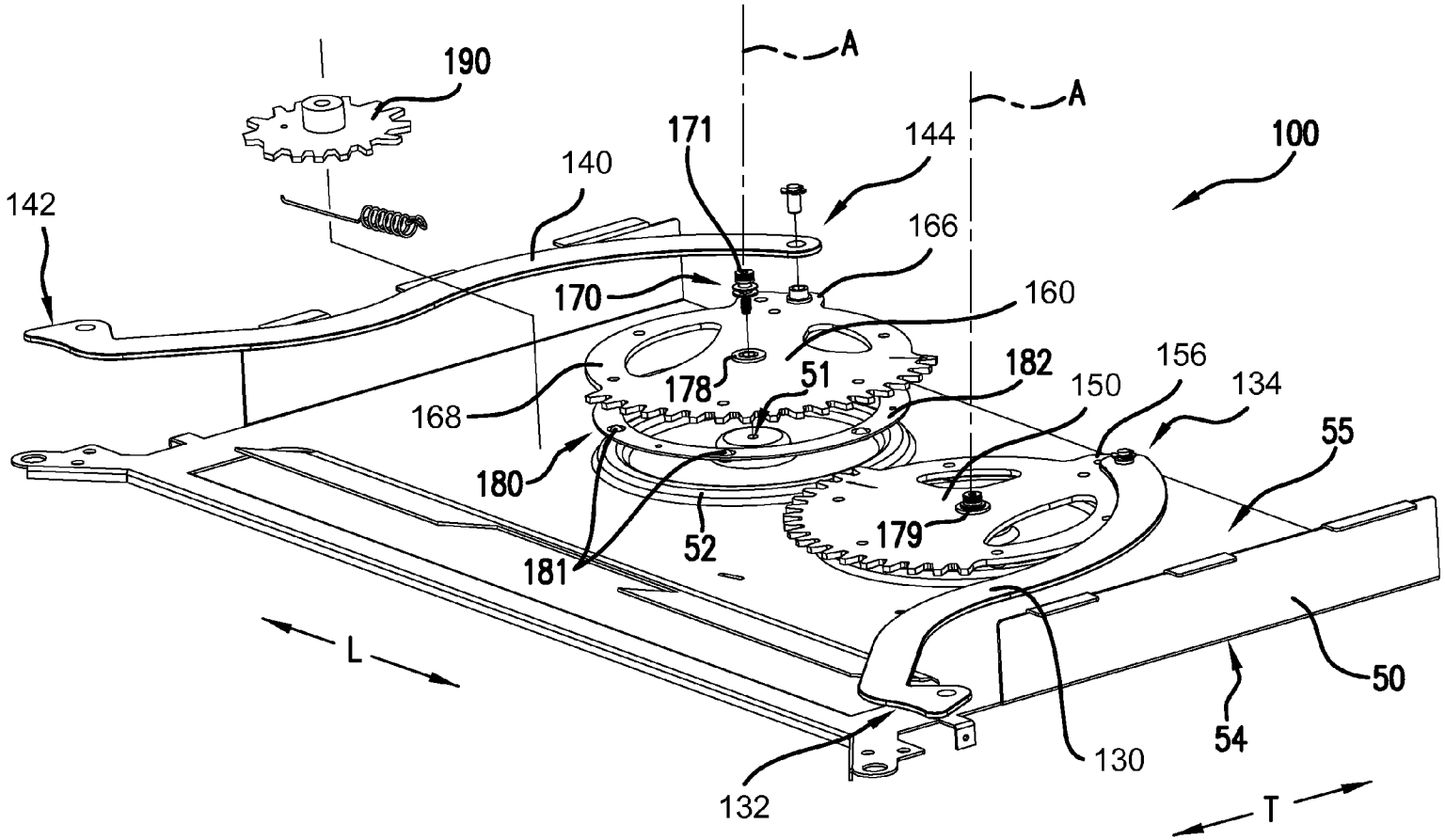
FIG. 7 is an inverted, partially exploded view of the linkage assembly and fastening assembly configured for securing a gear of the linkage assembly to the hood of the oven appliance.
Figure 8:
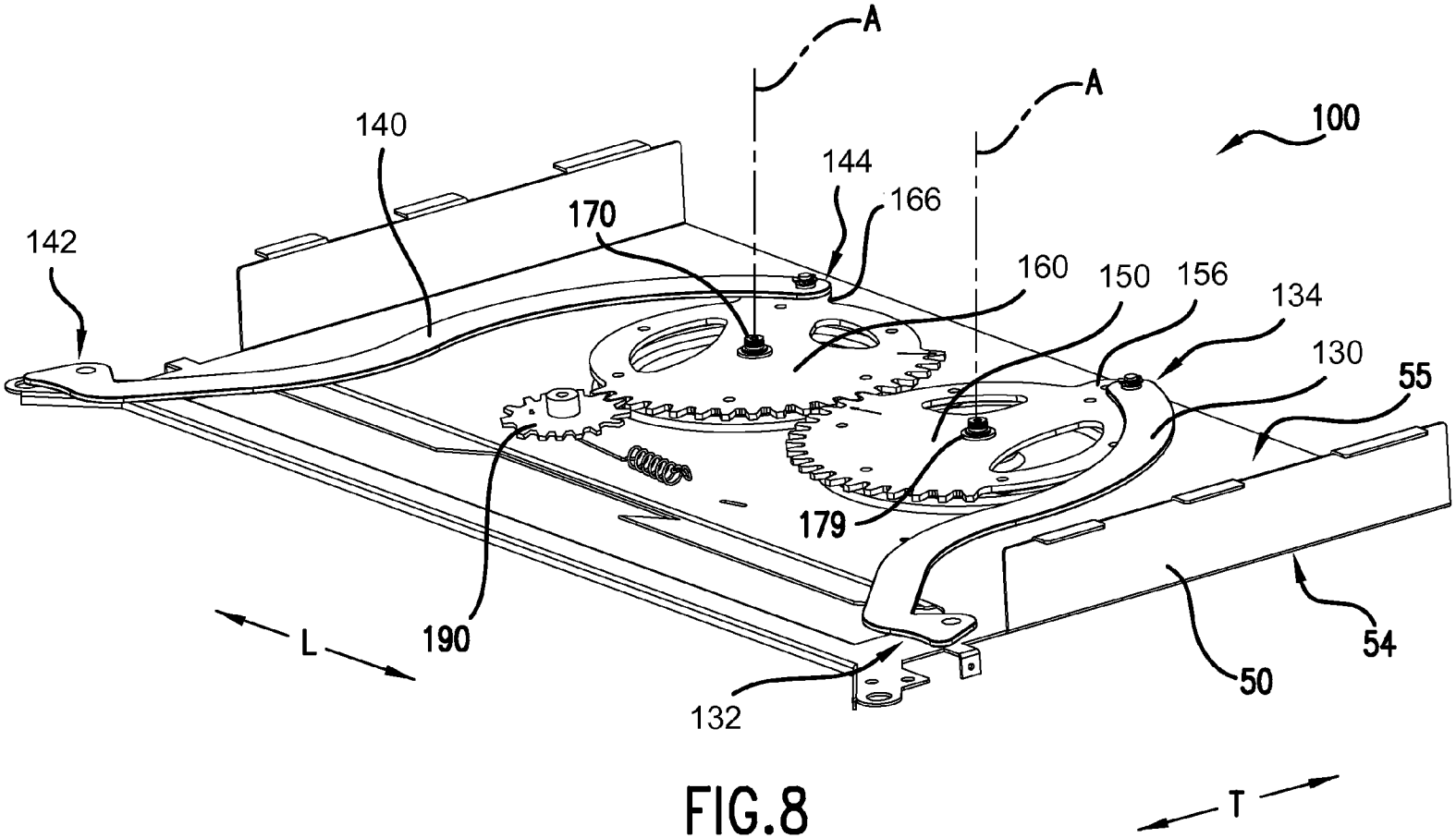
FIG. 8 is an inverted, perspective view of the linkage assembly with the fastening assembly securing the gear of the linkage assembly to the hood of the cabinet.
Figure 9:
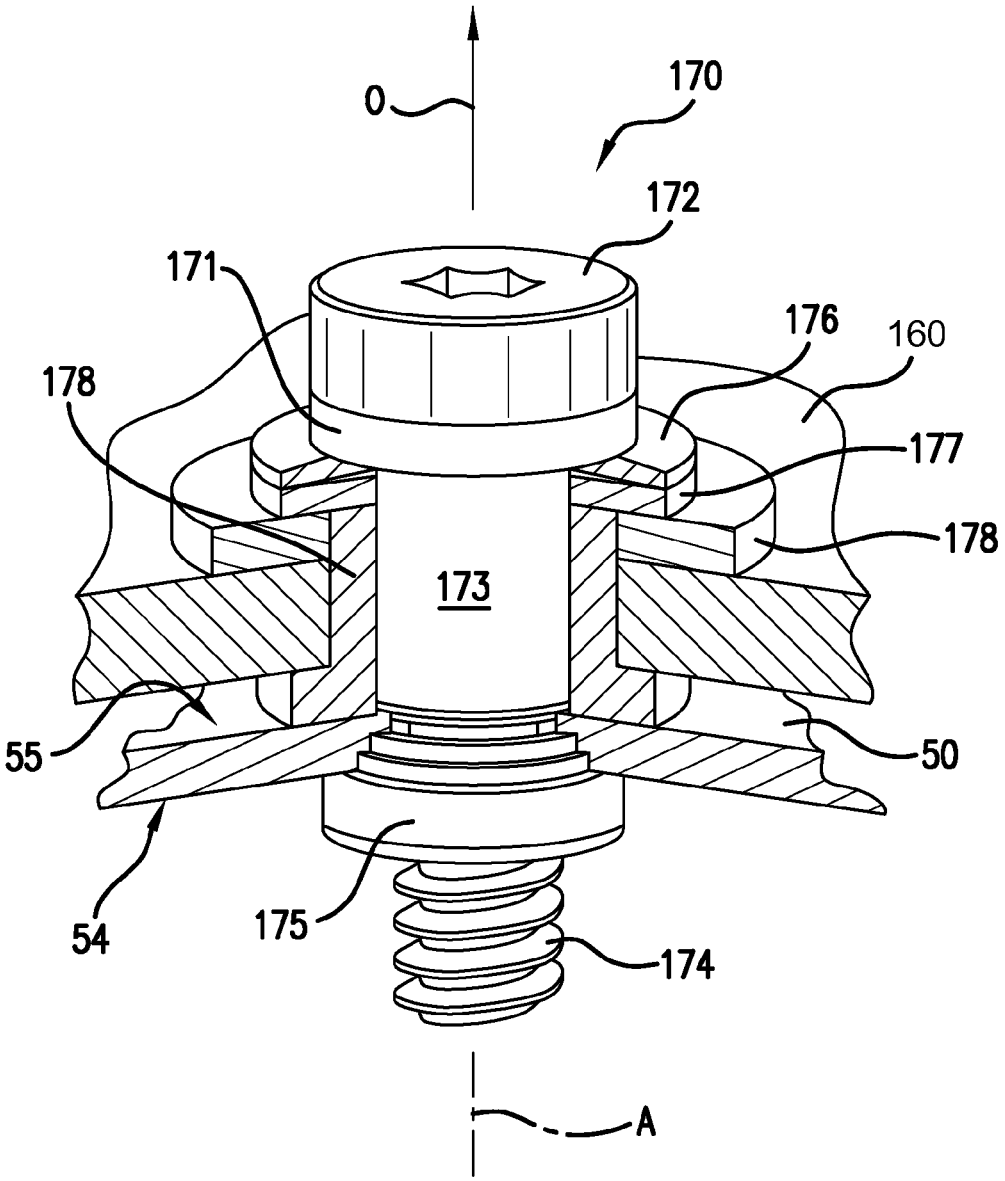
FIG. 9 is a partial, cross-sectional view of the fastening assembly of FIG. 8 securing the gear of the linkage assembly to the hood of the cabinet.

FIG. 7 is an inverted, partially exploded view of linkage assembly 100 and a fastening assembly 170 configured for securing second gear 160 of linkage assembly 100 to hood 50 of cabinet 12. FIG. 8 is an inverted, perspective view of fastening assembly 170 securing second gear 160 of linkage assembly 100 to hood 50 of cabinet 12. FIG. 9 is a partial, cross-sectional view of fastening assembly 170 securing second gear 160 of the linkage assembly 100 to hood 50 of cabinet 12. An additional fastening assembly 179 that is substantially identical to fastening assembly 170 is used to secure first gear 150 to hood 50.

As may be seen in FIG. 9, fastening assembly 170 includes a bolt 171, a self-clinching fastener 175, and a spring washer 176. Bolt 171 includes a head 172, a smooth portion 173, and a threaded portion 174. Smooth portion 173 of bolt 171 is disposed between head 172 of bolt 171 and threaded portion 174 of bolt 171 along a longitudinal direction O defined by bolt 171. Hood 50 of cabinet 12 is positioned at top 40 of cabinet 12. Hood 50 has an exterior surface 54 and an interior surface 55. Hood 50 also defines an opening 51 (FIG. 7).

Bolt 171 extends through opening 51 (FIG. 7) of hood 50 to mount second gear 160 to cabinet 12. In particular, smooth portion 173 of bolt 171 is disposed within opening 51 of hood 50. Self-clinching fastener 175 is threaded onto threaded portion 174 of bolt 171. In particular, self-clinching fastener 175 is positioned against exterior surface 54 of hood 50 and engages exterior surface 54 of hood 50 in order to secure self-clinching fastener 175 on exterior surface 54 of hood 50. Head 172 of bolt 171 is positioned adjacent second gear 160. Spring washer 176 is disposed on smooth portion 173 of bolt 171 such that spring washer 176 is positioned at head 172 of bolt 171, e.g., between head 172 of bolt 171 and second gear 160 along the longitudinal direction O. Fastening assembly 170 also includes a bushing 178 secured to second gear 160 to facilitate rotation of second gear 160 about axis of rotation A of second gear 160. For example, smooth portion 173 of bolt 171 may rotate on bushing 178. Fastening assembly 170 also includes a flat washer 177 disposed on smooth portion 173 of bolt 171 between head 172 of bolt 171 and spring washer 176.

As will be understood by those skilled in the art, fastening assembly 170 is provided by way of example only. Other suitable alternative mechanisms may be used to rotatably mount first gear 150 and/or second gear 160 to hood 50 or any other portion of cabinet 12.

Turning back to FIG. 7, linkage assembly 100 includes a guiding assembly 180 for stabilizing second gear 160. An additional guiding assembly (not shown) that is substantially similar to guiding assembly 180 is also provided to stabilize first gear 150. Guiding assembly 180 includes a plurality of bearings 181 rotatably mounted to a carrier 182. In the exemplary embodiment shown in FIG. 7, carrier 182 is substantially circular.

In addition, hood 50 of cabinet 12 includes a track 52 that projects away from interior surface 55 of hood 50. In the exemplary embodiment shown in FIG. 7, track 52 is substantially circular to match carrier 182. Second gear 160 includes a circumferential course 168 that is disposed radially away from axis of rotation A of second gear 160. Circumferential course 168 is complementary in shape to both track 52 of hood 50 and carrier 182.

In the assembled configuration shown in FIG. 7, plurality of bearings 181 contact with and roll against both track 52 of hood 50 and circumferential course 168 of second gear 160. By engaging both track 52 and circumferential course 168, plurality of hearings 181 can stabilize rotation of second gear 160 about axis of rotation A of second gear 160. For example, plurality of bearings 181 can hinder unwanted deflection of plurality of teeth 164 of second gear 160. In particular, plurality of bearings 181 can hinder axial displacement of plurality of teeth 164 of second gear 160 on the axis of rotation A of second gear 160.

In addition, plurality of bearings 181 can cooperate with spring washer 176 of fastening assembly 170 to hinder unwanted rotation of pair of doors 16 (FIG. 1). In particular, spring washer 176 can urge circumferential course 168 of second gear 150 and track 52 of hood 50 against plurality of bearing 181. Such urging can lead to increased friction between circumferential course 168 of second gear 160, track 52 of hood 50, and plurality of bearing 181. In turn, such friction can hinder unwanted rotation of pair of doors 16 as will be understood by those skilled in the art. Similar components or alternative components may be used at other rotational connections in linkage assembly 100 to increase friction and hinder unwanted rotation of pair of doors 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction and a transverse direction that are perpendicular to each other, the oven appliance comprising:

a cabinet defining a chamber for the receipt of food items for cooking, the chamber being accessible through an opening defined by said cabinet;

a heating element for providing heat to the food items for cooking in the chamber of said cabinet;

a first door rotatably mounted proximate the opening of said cabinet;

a second door rotatably mounted proximate the opening of said cabinet, said first door and said second door rotatable between an open position and a closed position in order to permit selective access to the chamber of said cabinet through the opening of said cabinet;

a pair of handles, each handle of the pair of handles mounted to a respective one of said first and second doors; and a linkage assembly coupling said first door and said second door such that said first door and said second door rotate between the open position and the closed position simultaneously when one of said first and second doors is manually rotated, said linkage assembly comprising:

a first linkage arm extending between a first end portion and a second end portion, the first end portion of said first linkage arm connected to said first door;

a first gear spaced apart from the first door along the transverse direction, the first gear having a plurality of teeth, the second end portion of said first linkage, arm rotatably connected to said first gear at a fixed point on said first gear;

a second gear spaced apart from the second door along the transverse direction, the second gear having a plurality of teeth, the plurality of teeth of said second gear engaging the plurality of teeth of said first gear; and a second linkage arm extending between a first end portion and a second end portion, the first end portion of said second linkage arm connected to said second door, the second end portion of said second linkage arm rotatably connected to said second gear at a fixed point on said second gear, the second linkage arm spaced apart from the first linkage arm along the lateral direction, wherein said first and said second gears each have an axis of rotation about which said first and second gears are respectively rotatable and an engagement edge radially spaced apart from the axis of rotation, the plurality of teeth of said first and second gears uniformly distributed on the engagement edge of said first and second gears, said first and said second gears having no teeth positioned opposite the engagement edge of said first and second gears, wherein said first and said second gears each have a leg positioned opposite the engagement edge of said first and second gears and extending radially away from the axis of rotation of said first and second gears by more than the radius of the plurality of teeth of said first and second gears, the second end portion of said first linkage arm rotatably mounted to the leg of said first gear, and the second end portion of said second linkage arm rotatably mounted to the leg of said second gear.

2. The oven appliance of claim 1, wherein said first and second gears are rotatably mounted to said cabinet.

3. The oven appliance of claim 2, further comprising a fastening assembly for rotatably mounting said first gear to said cabinet, said cabinet defining an opening for receiving said fastening assembly, said fastening assembly comprising:

a bolt having a head, a smooth portion, and a threaded portion, the smooth portion of said bolt disposed within the opening of said cabinet and extending through said first gear;

a self-clinching fastener threaded onto the threaded portion of said bolt; and a spring washer disposed on said bolt and positioned at the head of said bolt.

4. The oven appliance of claim 3, further comprising a guiding assembly for stabilizing said first gear during rotation of said first gear, said guiding assembly comprising:

a plurality of bearings in contact with said first gear and said cabinet, the spring washer of said fastening assembly urging the ball bearings of said guiding assembly against said first gear and said cabinet; and a carrier extending about said fastening assembly, said plurality of bearings rotatably mounted to said carrier.

5. The oven appliance of claim 4, wherein said cabinet comprises a track, said plurality of bearings positioned on said track such that said plurality of bearings contact both the track of said cabinet and said first gear during rotation of said first gear.

6. The oven appliance of claim 1, wherein said first and second gears are substantially identical.

7. The oven appliance of claim 1, wherein said first and second linkage arms are substantially identical.

8. The oven appliance of claim 7, wherein said first and second linkage arms are ogee shaped.

9. An oven appliance defining a lateral direction and a transverse direction that are perpendicular to each other, the oven appliance comprising:

a cabinet defining a chamber for receipt of food items for cooking, the chamber being accessible through an opening defined by said cabinet;

a heating element for providing heat to the food items for cooking in the chamber of said cabinet;

a pair of doors rotatably mounted proximate the opening of said cabinet, said pair of doors rotatable between an open position and a closed position in order to permit selective access to the chamber of said cabinet through the opening of said cabinet;

a pair of handles, each handle of the pair of handles mounted to a respective one of said pair of doors; and a linkage assembly coupling said pair of doors together such that said pair of doors rotate between the open position and the closed position simultaneously when one of said pair of doors is manually rotated, said linkage assembly comprising:

a pair of gears spaced apart from the pair of doors along the transverse direction, each gear of said pair of gears having an axis of rotation about which the gear is rotatable, each gear of said pair of gears having a plurality of teeth, the plurality of teeth of one of said pair of gears engaging the plurality of teeth of the other of said pair of gears, each gear of said pair of gears having an engagement surface radially spaced apart from the axis of rotation of the gear, the plurality of teeth disposed on the engagement surface; and a pair of linkage arms spaced apart from each other along the lateral direction, each linkage arm of said pair of linkage arms extending between and connecting one of said pair of doors and one of said pair of gears, an end portion of each linkage arm of said pair of linkage arms rotatably connected to a respective one of said pair of gears at a fixed point on the respective one of said pair of gears, wherein each gear of said pair of gears has no teeth positioned opposite the engagement edge, wherein each, gear of said pair of gears has a leg positioned opposite the engagement edge and extending radially away from the axis of rotation; by more than the radius of the plurality of teeth of said pair of gears, the end portion of each linkage arm of said pair of linkage arms rotatably connected to the respective one of said pair of gears at the leg on the respective one of said pair of gears.

10. The oven appliance of claim 9, wherein each gear of said pair of gears is rotatably mounted to said cabinet.

11. The oven appliance of claim 10, further comprising a fastening assembly for rotatably mounting one of said pair of gears to said cabinet, said cabinet defining an opening for receiving said fastening assembly, said fastening assembly comprising:

a bolt having a head, a smooth portion, and a threaded portion, the smooth portion of said bolt disposed within the opening of said cabinet and extending through the one of said pair of gears;

a self-clinching fastener threaded onto the threaded portion of said bolt; and a spring washer disposed on said bolt and positioned between the head of said bolt and said cabinet.

12. The oven appliance of claim 11, further comprising a guiding assembly for stabilizing one of said pair of gears during rotation of the one of said pair of gears, said guiding assembly comprising:

a plurality of bearings in contact with the one of said pair of gears and said cabinet, the spring washer of said fastening assembly urging the ball bearings of said guiding assembly against the one of said pair of gears and said cabinet; and a carrier extending about said fastening assembly, said plurality of bearings rotatably mounted to said carrier.

13. The oven appliance of claim 12, wherein said cabinet comprises a track, said plurality of bearings positioned on said track such that said plurality of bearings contact both the track of said cabinet and the one of said pair of gears during rotation of the one of said pair of gears.

14. The oven appliance of claim 9, wherein said pair of gears are substantially identical.

15. The oven appliance of claim 9, wherein said pair of linkage arms are substantially identical.

16. The oven appliance of claim 15, wherein said pair of linkage arms are ogee shaped.

* * * * *